United States Patent [19]

Zanetis

[11] Patent Number: 4,878,713

[45] Date of Patent: Nov. 7, 1989

[54] PAVEMENT PLANING MACHINE

[75] Inventor: C. Christopher Zanetis, Wauwatosa, Wis.

[73] Assignee: Alitec Corporation, Menomonee Falls, Wis.

[21] Appl. No.: 282,383

[22] Filed: Dec. 9, 1988

[51] Int. Cl.[4] ..... E01C 23/09

[52] U.S. Cl. ..... 299/39; 404/90

[58] Field of Search ..... 299/36, 39, 73; 404/90, 404/91, 98, 94

[56] References Cited

U.S. PATENT DOCUMENTS

| | | | |
|---|---|---|---|
| 3,829,161 | 8/1974 | Wirtgen | 299/39 |
| 4,262,966 | 4/1981 | Bouplon | 299/39 |
| 4,704,045 | 11/1987 | Taylor et al. | 299/39 X |
| 4,761,038 | 8/1988 | Hackmack | 299/39 X |
| 4,808,026 | 2/1989 | Clarke, Jr. et al. | 299/39 X |

FOREIGN PATENT DOCUMENTS

| | | | |
|---|---|---|---|
| 2504047 | 3/1977 | Fed. Rep. of Germany | 299/39 |
| 2040890 | 6/1977 | Fed. Rep. of Germany . | |
| 2152118 | 7/1985 | United Kingdom | 404/90 |

*Primary Examiner*—Jerome W. Massie
*Assistant Examiner*—David J. Bagnell
*Attorney, Agent, or Firm*—James E. Nilles; James R. Custin

[57] ABSTRACT

The pavement planer of this invention is carried on the front ends of the twin lift arms of a skid-steer front end loader. It has a drum with radially projecting picks, confined to rotation in a box-like housing that is open at its bottom and is supported at its front center on a heightwise adjustable roller. Secured to the lift arms, spanning the distance between them, is an upright plate-like frame member that rides on a roller on each of its ends. The housing is so connected to the frame member as to be laterally adjustable relative to it and also tiltingly adjustable about a fore-and-aft extending axis. Both of those adjustments are effected by a single hydraulic cylinder jack connected between the housing and the upright frame member. In use, a down load on the lift arms imposes part of the weight of the carrying vehicle onto the pavement planer, to be supported by the three mentioned rollers.

7 Claims, 5 Drawing Sheets

PAVEMENT PLANING MACHINE

FIELD OF THE INVENTION

This invention relates to pavement planning machines that are particularly useful for removing a slot-like strip of asphalt or similar pavement so that a trench for receiving a duct, cable or the like can be cut in the underlying soil; and the invention is more specifically concerned with such a machine that is adapted for removable installation on a self-propelled front end loader as a replacement for the bucket conventionally mounted on the front ends of its life arms, so that the pavement planing machine can be propelled forwardly by the end loader while the digging instrumentality of the machine is engergized from the end loader power plant.

BACKGROUND OF THE INVENTION

The most nearly pertinent prior art includes several machines for grooving, slitting or slotting pavement that are intended to be mounted on the boom of a road working or earth working machine. A recent example of these is U.S. Pat. No. 4,761,038, to Hackmack, issued Aug. 2, 1988. The machine disclosed by Hackmack is supported on pavement traversing rollers which are so mounted on adjustable frame arms as to provide for heightwise positioning of the axis of the rotary digging instrumentality, for controlling depth of cut. The arrangement is such that the frame arms tend to interfere with access to the digging instrumentality notwithstanding that no housing or enclosure for it is disclosed. Since the digging instrumentality of a machine of this type rotates at a fairly high speed (100–200 rpm), it tends to throw particles of pavement in practically all directions and thus endangers nearby persons and property unless it is substantially completely enclosed. On the other hand, when the digging instrumentality comprises a drum that has picks projecting substantially radially from its cylindrical surface, it is desirable that each pick be received in a socket that provides for its free rotation relative to the drum, for automatic equalization of wear on the picks; and therefore the drum should be readily accessible for regular lubrication of the pick sockets to facilitate such rotation.

The Hackman patent points out the advantages of arranging a planning machine to be carried by an earth working or road working machine that can provide a source of energization for the rotary digging instrumentality of the planning machine and can propel it for movement along the pavement during its operation. This allows the planning machine to be simple and inexpensive and at the same time increases the versatility and utility of the machine that serves as the carrying vehicle, which might otherwise stand idle while the planning machine is in use. As brought out in Hack mack and other references (e.g., U.S. Pat. No. 3,219,388 to Haynes; U.S. Pat. No. 3,829,161 to Wirtgen) the carrying vehicle may be a road scraper or a machine that has some type of boom or lift are arrangement. However, the type of machine most suitable for serving as a carrying vehicle is undoubtedly a front end loader, since such a machine is the one most likely to be needed for other purposes at a site where pavement planning is to be performed and is most likely to be part of the equipment available to a contractor doing such work. Thus a planning machine can be mounted on the twin lifting arms of a front end loader as a replacement for the bucket conventionally carried by those arms; and then, by forcefully lowering those arms to the point where the front wheels of the carrying vehicles are raised above the pavement, a substantial part of the weight of that vehicle is imposed upon the pavement planing machine for maintaining its digging instrumentality in effective engagement with the pavement, all as suggested by West German published patent application No. 2040890, published in 1971.

As a rule, a front end loader is substantially wider than the pavement slot usually needed for a utility trench, the slot width being on the order of 0.5 m (20–21 inches), which is aobut one-third the width of most front end loaders. The obvious position for a planning machine carried by a front end loader is midway between its lift arms, on the longitudinal centerline of the vehicle, since this position is most convenient for the operator under most conditions. However, it is often necessary to cut a pavement slot closely alongside a curb or wall, and here a pavement planning machine centered on a wide front end loader could not be used satisfactorily. In such a situation, too, it is usually desirable to feather or bevel the edge of the slot that is adjacent to the upright surface, to facilitate subsequent repaving. This requires that the axis of the rotary digging instrumentality be tilted out of the horizontal. Since most other operatios will require that the planning machine be operated with that axis horizontal or parallel to the plane of the pavement being worker, provision for tilting adjustment of that axis is obviously desirable.

The weight of a suitable planning machine is well over half a ton and therefore any provision for lateral and tilting adjustments of the machine must include powered means for shifting it in such adjustments. The obvious expedient would be to provide two hydraulic cylinder jacks, one for tilting, the other for lateral shifting, but it is also obvious that such an arrangement would be costly and complicated.

The prior art known to the applicant offers no suggestion for a planning machine adapted to be carried by a front end loader that is both laterally and tiltingly adjustable; much less is there any suggestion of simple, inexpensive and efficient means for accomplishing such dual adjustments.

SUMMARY OF THE INVENTION

The general object of the present invention is to provide a machine for planing asphalt and similar pavement, comprising a rotary digging instrumentality adapted to be mounted on the front ends of the twin lifting arms of a front end loader, as a replacement for the bucket conventionally mounted on them, sais machine being arranged for both lateral adjustment across the width of the front end loader and for tilting adjustment whereby the rotational axis of the digging instrumentality can be oriented either horizontally or at any of a range of inclinations to the horizontal.

Another object of the invention is to provide a pavement planing machine of the character just described that features simple, inexpensive and sturdy means for achieving such adjustability and with which both lateral and tilting adjustments can be accomplished quickly and easily.

A further and more specific object of the invention is to provide a pavement planing machine which achieves the above stated objects and which ahs a single hydraulic cylinder jack that effects both horizontal shifting adjustment and tilting adjustment.

Another specific object of the invention, and an important one from the standpoint of the user, is to provide a pavement planing machine wherein the rotary digging instrumentality comprises a drum having numerous subsantially radially extending picks, wherein that drum is fully enclosed to ensure the safety of nearby persons and property but is nevertheless very readily and completely accessible for maintenance, and wherein the drum can be very quickly and easily installed and removed with the employment of the powered lifting means normally present on a front end loader that carries the machine for its operation.

These and other objects of the invention that will appear as the description proceeds are achieved in the pavement planing machine of this invention, which is adapted for installation on a front end loader or similar vehicles, as a replacement for the shovel normally present on the vehicle. Such a vehicle has a pair of lift arms, each outwardly adjacent to one of a pair of opposite sides of the vehicle, which are swingable up and down in unison about a laterally extending arm axis near a rear end of the vehicle and which project forward from the axis to have front ends in front of a front end of the vehicle. Attachment means on the front ends of those arms provide for removable attachment of a bucket to them and for swinging of the bucket relative to them about a bucket axis that is near their front ends and is parallel to said arm axis. The vehicle also has pressure fluid energizable arm actuating means connected with a pressure fluid source on the vehicle for controlledly raising and lowering said arms.

The pavement planing machine of this invention is characterized by a housing that is substantially open at its bottom, which housing has a top wall, a pair of opposite upright side walls spaced apart by a distance substantially smaller than the distance between said arms, a laterally extending front member rigidly connected with said side walls at front ends of them, and a plate-like edgewise upright and laterally extending rear wall rigidly secured to said side walls at rear ends of them and having at least one marginal portion which projects edgewise outwardly beyond one of the other of said walls. There are mounting means on each of said side walls for removably supporting a digging instrumentality that is rotatable in the housing, said mounting means defining a rotation axis substantially normal to said side walls about which said instrumentality is rotatable and which is fixed in relation to the housing to partake of all motion thereof. The machine is further characterized by an upright frame member that is removably securable to said attachment means to replace the bucket and to be swingable about said bucket axis. That frame memeber has laterally opposite ends and has a width between those ends to extend laterally across the entire distance between said arms. A carrier is confined between said frame member and the rear wall of the housing, and cooperating guide means on the frame member and the carrier confine the latter to lateral motion relative to the frame member between an off-center position near one of said ends of the frame member and a central position intermediate said ends of the frame member. Cooperating pivot means on the carrier and on the rear wall of the housing confine the housing to tilting adjustment relative to the carrier about a fore-and-aft extending tilting axis which is at a level below said rotation axis and is adjacent to the side wall of the housing that is remote from said one end of the frame member, and cooperating releaseable clamping means on the carrier and on said marginal poriton of the rear wall releasably confine the housing against tilting relative to the carrier and thus maintain the rotation axis in a selected position of inclination to the horizontal. Pressure fluid actuated expansible and retractable jack means connectable with said fluid pressure source has at one end thereof a connection with the fram member that is near the other of its said ends and near the level of said pivot conneciton and has at an opposite end of it a conneciton with the housing that is at a level substantially above the rotational axis and is adjacent to said side wall that is remote from said one end of the frame member, so that said jack means can effect lateral shifting of the carrier relative to the frame member and can control tilting of the housing relative to the carrier.

Other characterizing features of a preferred embodiment of the invention will appear from the following description and the accompanying claims.

BRIEF DESCRIPTION OF THE DRAWINGS

In the accompanying drawings, which illustrate what is now regarded as a referred embodiment of the invention.

DETAILED DESCRIPTION OF PREFERRED EMBODIMENT OF THE INVENTION

Figure 1:
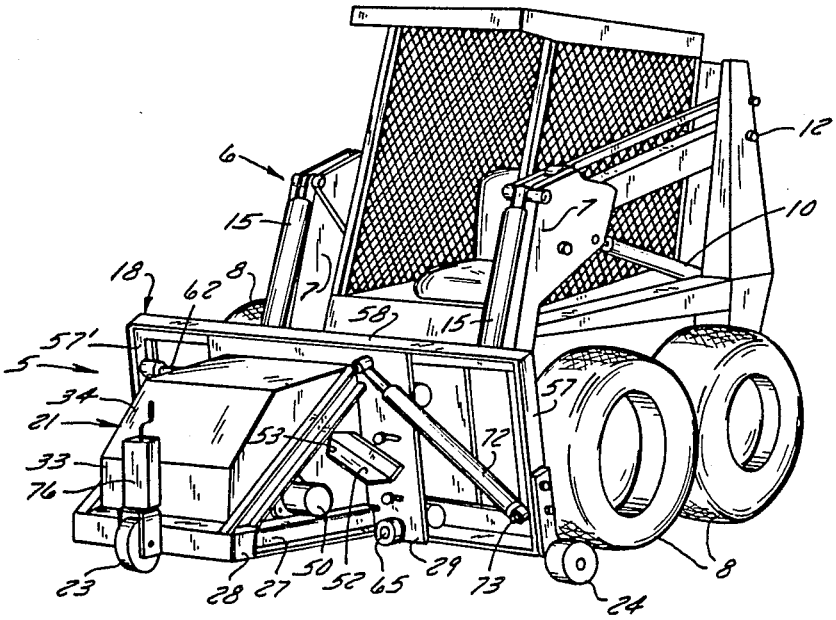
FIG. 1 is a perspective view of a pavement planing machine of this invention mounted on a front end loader.

As best seen in FIG. 1, a pavement planing machine 5 of this invention is adapted to be carried on a generally conventional front end loader 6, on the front ends of its lift arms 7 as a replacement for the bucket (not shown) which is ordinarily attached to those arms. The preferred front end loader is of the skid-steer type, having large front and rear traction wheels 8 at each of its sides, all of them non-steerable. The two wheels 8 at each side always rotate in unison, and steering is effected by causing the wheels 8 at one side to rotate at a different speed and/or in the opposite direction from those at the other side. As is conventional, the front end loader includes a hydraulic pressure fluid source (not shown) that is connected with hydraulic jack cylinders 10 which effect raising and lowering of the lift arms 7. That pressure fluid source on the carrying vehicle also serves for energizing the hereinafter described power means on the pavement planing machine 5.

The two lift arms 7, which overlie opposite sides of the front end loader, are connected to its chassis by means of coaxial trunnions 12 that define a laterally extending arm axis about which the arms swing up and down and which axis is located at a rear end of the vehicle and at a level well above its wheels 8. The arms 7 project generally forwardly from this axis to have front ends ahead of the front end of the carrying vehicle. On the front ends of these arms are attachment means designated generally by 14 that provide for readily detachable securement of the bucket and for swinging of the bucket relative to the arms about a bucket axis which is parallel to the arm axis. Such swinging of the bucket is controlled by a pair of bucket tilting jack cylinders 15, one for each arm, each having a connection with its arm and another and detachable connection with the bucket.

The planing machine 5 comprises a frame member 18 on which there are fittings that corresponds to those on the bucket, so that the machine 5 can be attached to the arms 7 in the same manner as the bucket and as a replacemnt for it. This frame member 18 also has trunnion means 16 for detachable conneciton with the bucket tilting jacks 15, corresponding to the means on the bucket for connecting it to those jacks.

In general, the machine 5 comprises a rotary digging instrumentality 20, a housing 21 which is open at its bottom but which otherwise encloses and surrounds the digging instrumentality and also provides rotatable mounting support for it, and a tricycle carriage upon which the housing is supported for traversing a pavement and which comprises a front roller 23 and two coaxially mounted rear rollers 24. As described hereinafter, the housing 21 has a connection with the frame member 18 which is essentially rigid when the machine is in opertion but which provides for shifting adjustment of the housing relative to the frame member both laterally and in limited tilting about a fore-and-aft extending tilting axis.

The housing 21 comprises a pair of sturdy upright side walls 26, preferably reinforced by channels or ribs 27 that are welded to their outer surfaces. These side walls 26, which are spaced apart by a distance substantially smaller than the distance between the arms 7, are substantially parallel to one another and are rigidly connected at their front ends with a sturdy tranversely extending front member 28. A rear wall 29 of the housing, which is rigidly connected with the rear ends of the side walls, is preferably a flat and rectangular plate that has a width substantially greater than the distance between the side walls to have opposite marginal portions 30 and 31, each of which projects edgewise laterally beyond one of the side walls and extends vertically along the full height of that side wall.

Figure 2:
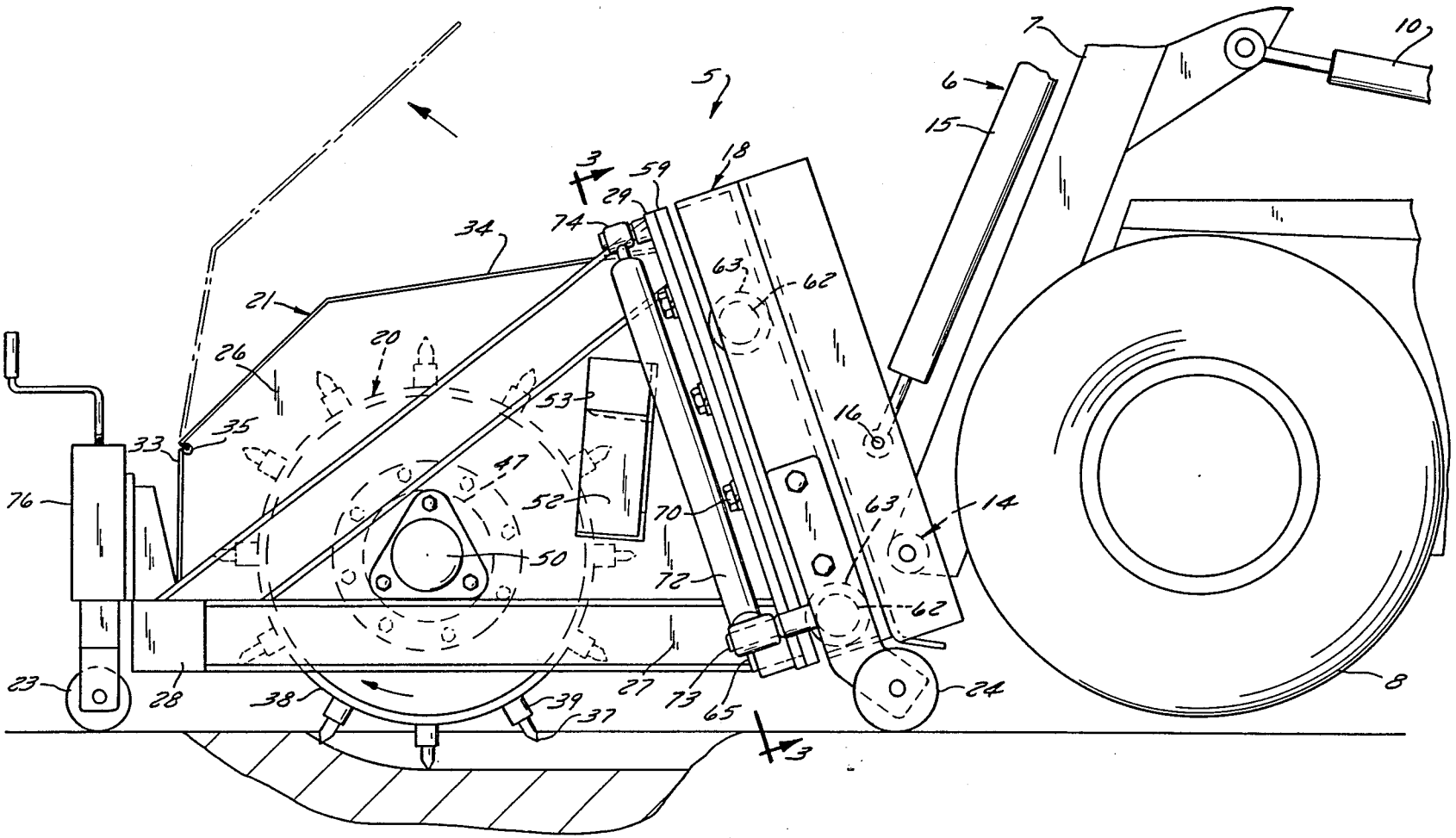
FIG. 2 ia a view in side elevation of the pavement planing machine in its operative relation to the front end loader.
Figure 4:
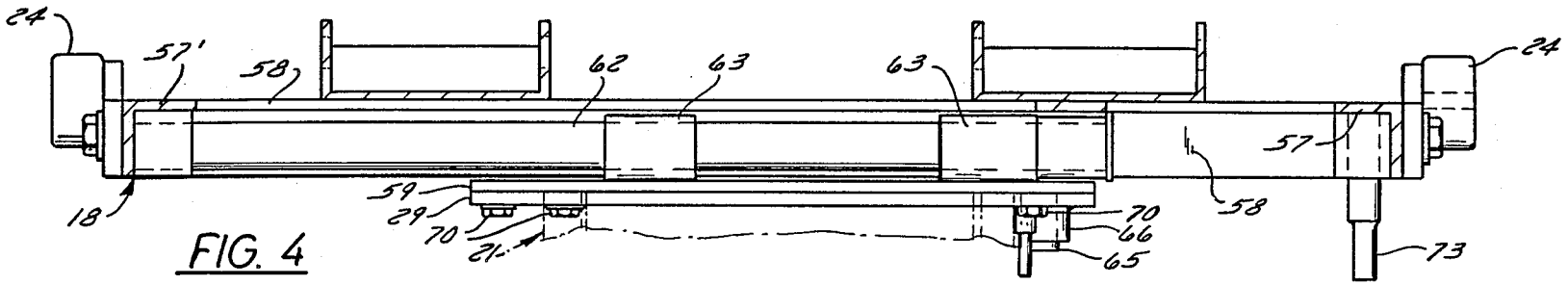
FIG. 4 is a plan view of substantially the portion of the machine shown in FIG. 3.
Figure 3:
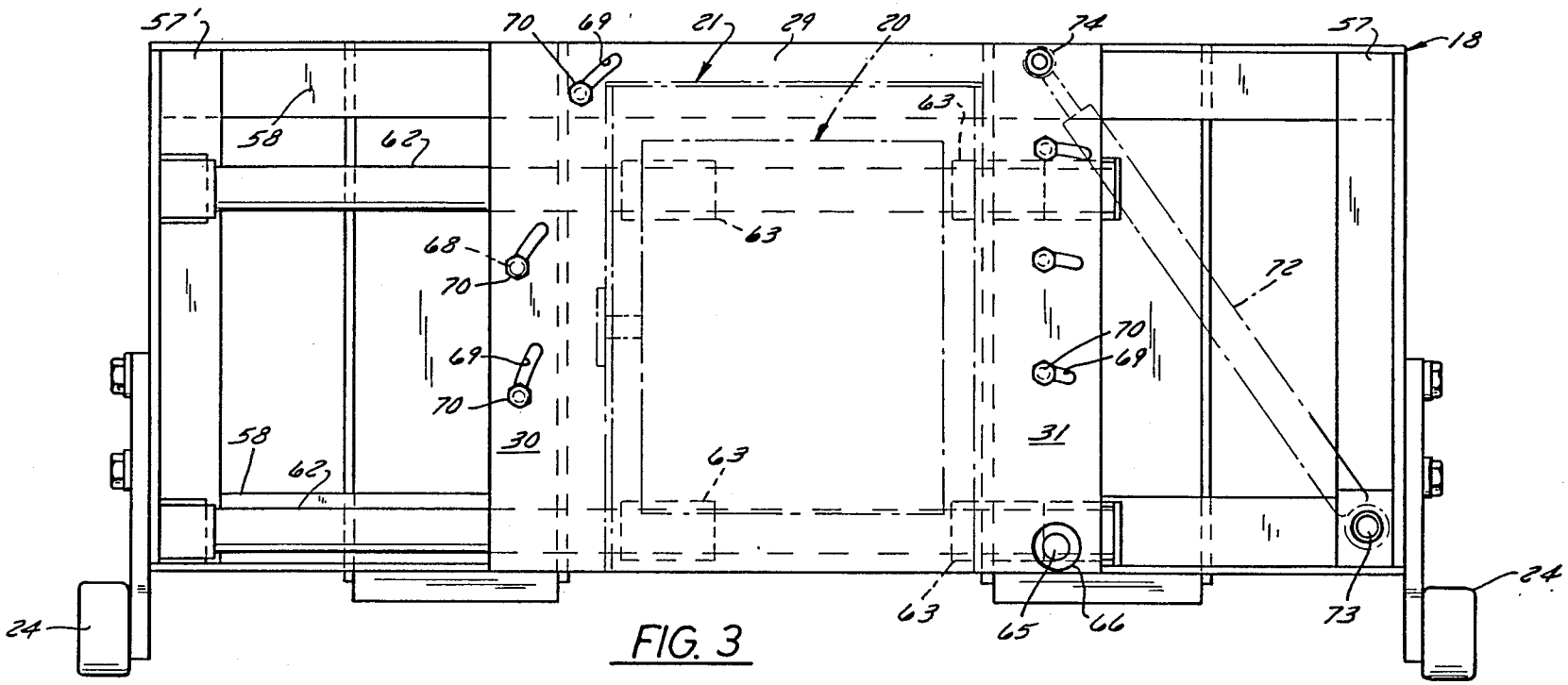
FIG. 3 is a view in section taken substantially on the plane of the line 3—3 in FIG. 2 and showing the conditions of adjustment in which the housing is in its central position and the rotation axis of the digging instrumentality is horizontal.

The housing also includes a front wall plate 33, which comprises an upper part of the front member 28, and a top wall 34. Along its front edge the top wall 34 has a hinge connection 35 with the top edge of the front wall plate 33, so that the top wall can be swung forwardly and upwardly, as indicated in FIG. 2, to an open position in which th eentire digging instrumentality 20 is readily accessible. In its closed normal position the top wall 34 rests on the upper edges of the side walls 26, and it is heavy enough to remain firmly seated on them, although a suitable latch can be provided if desired.

As here illustrated, the digging instrumentality 20 is essentially a cylindrical drum on which there are numerous radially outwardly projecting picks 37. It will be understood that this drum-like tool could be replaced by a rotary cutting disc, or by a group of such discs mounted coaxially at axially spaced intervals, depending upon the nature of the pavement cutting to be done. The illustrated drum is hollow, having a cylindrical wall 38 on the exterior of which sockets 39 for the several picks 37 are rigidly and permanently secured. Each pick 37 is of a hard metal such as carbide. In a known arrangement, each pick is so secured in its sockter 39 as to be readily removable for replacement when it becomes excessively worn, and also to be freely rotatable so that it tends to be abraded away uniformly all around it. However, the picks should be lubricated regularly, to ensure their freedom for such rotation. It will be apparent that the hinged top wall 34 greatly facilitates lubrication and replacement of the picks.

Secured to the cylindrical wall 38 of the drum, in its interior, are a pair of radially extending flanges 40, 41, each inwardly adjacent to an end of the cylindrical wall and each having a central aperture. Secured to the outer face of the flange 40 is a bearing ring 43 in which a stationary stub shaft 44 is axially slidably and rotatably receivable. Concentrically fixed to the outer end of the stub shaft 44 is an enlarged flange-like head 45 which overlies the outer surface of the side wall 26 that is adjacent to the flange 40 and is removably bolted to that side wall. At its other end the drum is supported from the other side wall 26 by means of a planetary transmission mechanism 47 of a commerically available type that comprises a relatively stationary element 48 and a coxial relatively rotatable element 49, each of which elements comprises a circular radially outwardly projecting mounting flange. The relatively rotatable element 49 is detachably bolted to the flange 41 of the drum, while the stationary element 48 is removably secured in a similar manner to the adjacent side wall 26. Also bolted to the same side wall, and projecting outwardly from it, is a rotary hydraulic motor 50 which has its shaft 51 projecting into the relatively rotatable element 49 of the transmission mechanism and drivingly engaged therewith. The drum 20 is thus jointly supported for rotation by the stub shaft 44 and the transmission mechanism 47, and the latter also serves for transmitting torgue to the drum from the motor 50, which is connectable for energization with the pressure fluid source in the vehicle.

The drum preferably rotates opositely to the direction in which the traction wheels 8 rotate for forward propulsion. Thus pavement particles dug out by the drum are thrown upwardly and rearwardly in the housing. To prevent them from falling back down into the slot dug out by the machine, a shelf-like chute 52 is preferably mounted in the rear portion of the hhousing, at about the level of the top of the drum. The chute extends laterally all across the interior of the hounsing and is inclined downwardly towards one of the side walls 26, in which there is an outlet 53 through which the chute projects for discharge alongside the path of the machine.

The frame member 18, which provides a connection between the housing 21 and the arms 7 of the carrying vehicle, is built up of channel members or the like to have a rectangular shape, with an upright member 57 at each of its laterally opposite ends, connected by longer horizontal members 58.

Figure 5:
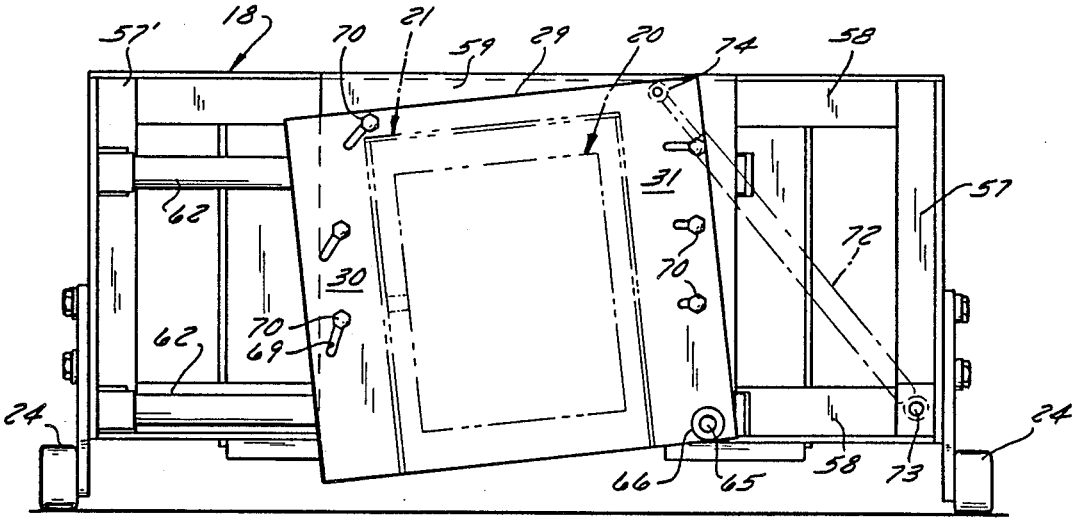
FIG. 5, on the same sheet with FIG. 1, is a view generally like FIG. 4 but showing the housing tilted to dispose the rotation axis at an inclination to the horizontal.
Figure 6:
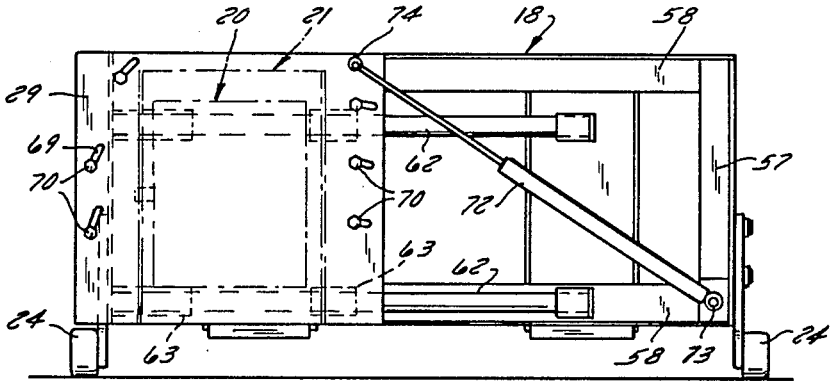
FIG. 6 is another view generally like FIG. 4 but showing the housing adjusted to its off-center position and untilted.
Figure 7:
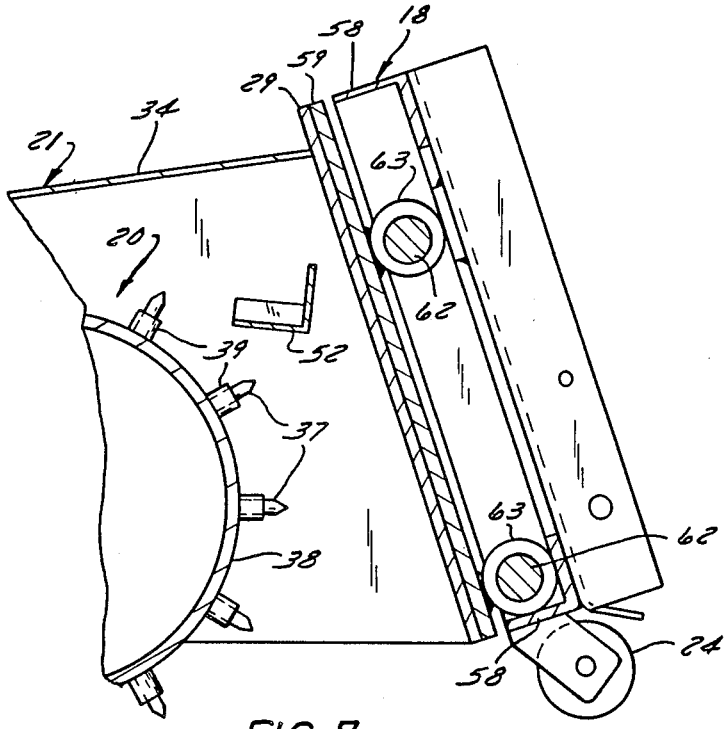
FIG. 7 is a fragmentary view in vertical section normal to the rotation exis through the rear poriton of the machine.
Figure 8:
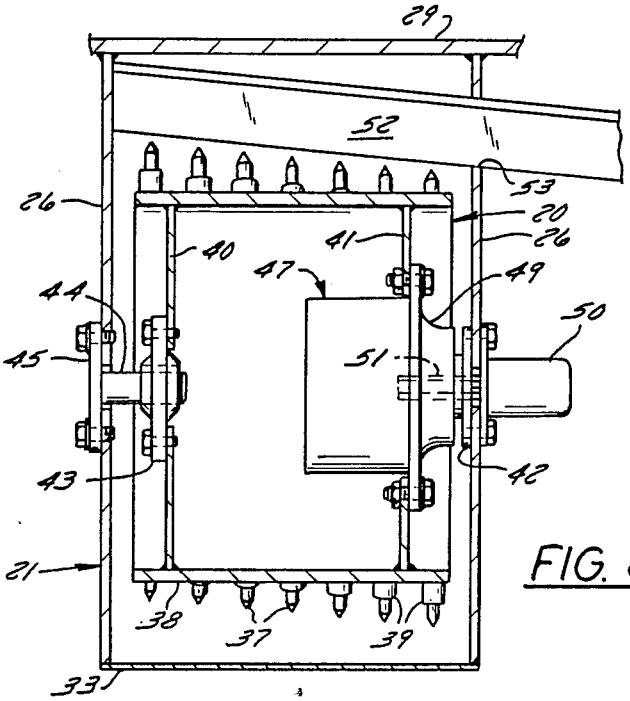
FIG. 8 is a fragmentary view in horizontal section through the housing, taken on a plane just above the rotation axis.

The connection between the frame member 18 and the housing 21 comprises a carrier 59, preferably in the form of a flat plate which forwardly overlies the frame member and which, in turn, has its front surface flatwise slidably overlain by the rear wall 29 of the housing. The carrier 59 is so mounted on the frame member 18 as to be confined to lateral shifting relative to it between a central position (FIGS. 1 and 5) in which the carrier is about midway between the uprights 57 of the frame member and an off-center position in which the carrier is closely adjacent to one of those upright members 57' (FIG. 6). The connection between the frame ember 18 and the carrier 59 thus comprises sturdy parallel guide rods 62 fixed to the frame memeber and extending along a major portion of its length from said one upright member 57' , and slide bearings 63 that are fixed to the rear surface of the carrier and embrace those rods. The slide bearings 63 cooperate with the mounting means which support the guide rods 62 at their opposite ends to define limits of lateral shifting of the carrier at the abovementioned positions.

Figure 9:
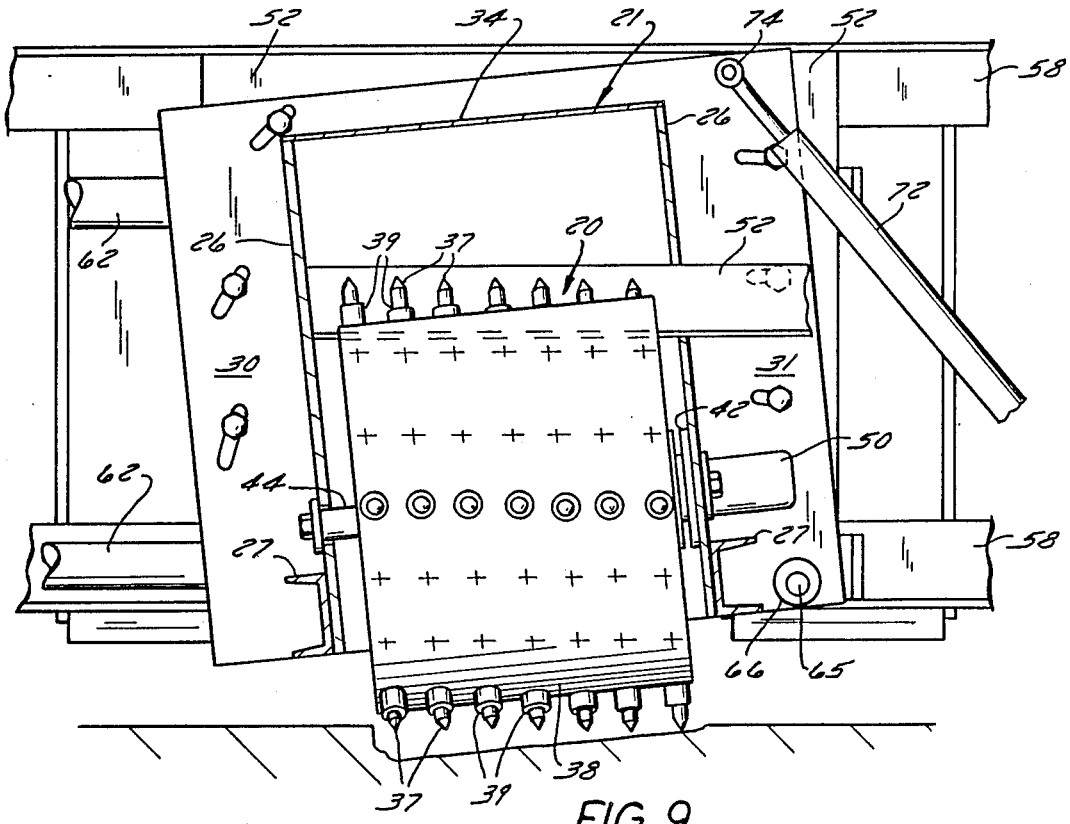
FIG. 9 is a fragmentary view in vertical section, looking rearward from a plane that is slightly forward of the rotation axis and parallel to it.

The connection between the rear housing wall 29 and the carrier 59 confines the housing 21 to tilting relative to the carrier and thus constrains the housing to move in lateral adjustment with the carrier. This tilting connection comprises a short forwardly projecting trunnion 65 that is fixed on the carrier, received in an axially short tubular bearing 66 fixed on the rear wall and projecting forwardly from its front surface. The bearing 66 is on the marginal portion 31 of the rear wall 29, and it and the trunnion 65 are so positioned that the fore-and-aft extending tilting axis which they define is at a level below the rotation axis and is at the side of the housing 21 that is remote from the upright end member 57'of the frame member 18. Since the tilting axis is well to one side of the center of gravity of the housing 21, the housing tends to swing about it to a position in which the rotation axis is substantially inclined to the horizontal, as shown in FIGS. 5 and 9. However, the housing can be releasably confined in any desired position of such adjustment by clamping means reacting between its rear wall 29 and the carrier 59. As here shown, the clamping means comprises a number of threaded studs 68 that are secured to the carrier and project forwardly from it through arcuate slots 69 in the rear wall 29, and nuts 70 threaded onto those studs for engagement aganist the rear wall. The arcuate slots 69 are located in the marginal portions 30, 31 of the rear wall 29, so that the nuts 70 are readily accessible for tightening and loosening when the housing is to be tiltingly adjusted.

A single extensible and retractable cylinder jack 72, connectable with the pressure fluid source on the carrying vehicle, serves both to effect lateral shifting of the housing 21 relative to the frame member 18 and to control tilting of the housing relative to the frame member 18 and the carrier 59. At one of its end that jack 72 has a pivoted connection 73 with the frame member 18, which connection is near the bottom of the frame member and near its end 57 that the housing stays away from. The other end of the jack 72 has a pivot connection 74 with the rear wall 29 of the housing that is near the top of the housing, in the marginal portion 31 of that wall 29 and outwardly adjacent to the side wall 26 which is nearest that jack.

It will be apparent that when the housing 21 is clamped to the carrier 59, extension of the jack 72 shifts the housing towards its off-center position and retraction of the jack shifts it towards its central position, while the clamping means 68, 70 confines the housing in an previously selected position of tilting adjustment. For tilting the housing out of a position in which the rotation axis is horizontal, the jack 72 is extended to bring the housing all the way to its off-center position, the nuts 70 are loosened to permit the housing to swing about the tilt axis, and the jack 72 is then further extended to control such tilting, the nuts 70 being retightened when the desired inclination of the rotation axis is attained. To readjust the tilted housing towards or to the horizontal attitude of the rotation axis, the jack is retracted to bring the housing all the way to its central position, the nuts 70 are e loosened, the jack 72 is then further retracted to tilt the housing to the new desired attitude, and the nuts are retightened.

The tricycle carriage comprising the front rollers 23 and the two rear rollers 24 is so arranged that those rollers always ride on unaffected pavement when the machine is in normal operation. Thus the coaxial rear rollers 24 are mounted at opposite ends of the frame member 18, to be spaced to opposite sides of a slot being cut by the machine, while the front roller 23 is centrally mounted on the front member 28 of the housing, to be spaced in front of the zone of operation of the digging instrucmentality 20. The mounting 76 for the front roller 23 comprises a manually actuatable jack screw for heightwise adjustment of that roller that regulates the depth of cut made by the machine. Its range of adjustment should be such as to provide for a zero cutting depth and maximum depth of cut which can be on the order of 5 in. (10 cm).

The zero depth of cut adjustment facilitates centering the cutting instrumentality relative to the housing when that instrumentality is being mounted. For such assembly the cutting instrumentality is placed at any convenient location and the housing 21, attached to a front end loader as described above, is elevated by raising the lift arms 7, then transported over to the cutting instrumentality and lowered into place around it.

In operation of the machine, the lift arms 7 of the vehicle that carries it are forced down to the point where the front traction wheels 8 are spaced above the pavement, as shown in FIG. 2 so that a substantial part of the weight of the vehicle is imposed upon the machine 5 while the vehicle is supported by that machine and its rear traction wheels. The rollers 23, 24 on the machine are not castered, since the machine is normally required to operate along a substantially straight path. Such minor course corrections as may be necessary are affected by differential rotation of the rear traction wheels 8 and attendant skidding of the rollers 23, 24 on the pavement being worked.

From the foregoing description taken with the accompanying drawings it will be apparent that this invention provides a pavement planing machine which is nicely suitable for attachment to a front end loader, as a replacement for the bucket that it normally carries, and which is adjustable laterally in relation to the end loader, tiltingly to dispose the rotation axis of its cutting instrumentality at desired inclinations to the horizontal, and heightwise for controlling depth of cut, but which is nevertheless relatively simple, inexpensive, easily maintained, and efficient in operation.

What is claimed is:

1. A pavement planing machine for removable attachment to a self-propelling vehicle such as a front end loader, said vehicle having a pair of lift arms. each outwardly adjacent to one of a pair of opposite sides of the vehicle, said arms being swingable up and down in unison about a laterally extending arm axis near a rear end of the vehicle and projecting forward from that axis to have front ends in front of a front end of the vehicle, attachment means on the front ends of said arms providing for removable attchment of a bucket to said arms and for swinging of the bucket relative to said arms about a bucket axis that is near their front ends and is parallel to said arm axis, and pressure fluid energizable arm actuating means connected with a pressure fluid source on the vehicle for controlledly raising and lowering said arms, said pavement planing machine comprising:

A. a housing that is substantially open at its bottom, said housing having
  (1) a top wall,
  (2) a pair of opposite upright side walls spaced apart by a distance substantially smaller than the distance between said arms,
  (3) a laterally extending front member rigidly connected with said side walls at front ends of them, and
  (4) a plate-like edgewise upright and laterally extending rear wall
    (a) rigidly secured to said side walls at rear ends of them and
    (b) having at least one marginal portion which projects edgewise outwardly beyond one of the other of said walls;

B. mounting means on each of said side walls for removably supporting a digging instrumentality that is rotatable in the housing, said mounting means defining a rotation axis substantially normal to said side walls about which said instrumentality is rotatable and whic is fixed in relation to said housing to partake of all motion thereof;

C. an upright frame member removably securabel to said attachment means to replace said bucket and to be swingable about said bucket axis, said frame member having laterally opposite ends and having a width between those ends to extend laterally across the entire distance between said arms;

D. a carrier confined between said frame member and said rear wall;

E. cooperating guide means on said frame member and on said carrier confining the latter to lateral motion relative to the frame member between an off-center position near one of said ends of the frame member and a central position intermediate said ends of the frame member;

F. cooperating pivot means on said carrier and on said rear wall of the housing confining the housing to tilting adjustment relative to the carrier about a fore-and-aft extending tilting axis which is at a level below said rotation axis and is adjacent to the side wall of the housing that is remote from said one end of the frame member;

G. cooperating releasable clamping means on said carrier and on said marginal portion of the rear wall for releasably confining the housing against tilting relative to the carrier and thus maintaining the rotation axis in a selected position of inclination to the horizontal; and H. pressure fluid actuated expansible and retractable jack means
  (1) connectable with said pressure fluid source,
  (2) having at one end thereof a connection with said frame member that is near the other of its said ends and near the level of said pivot connection and
  (3) having at an opposite end thereof a connection with said housing that is at a level substantially above said rotation axis and is adjacent to said side wall that is remote from said one end of the frame member, so that said jack means can effect lateral shifting of the carrier relative to the frame member and can control tilting of the housing relative to the carrier.

2. The pavement planing machine of claim 1, further characterized by:

three rollers upon which the machine is supported for traversing a pavement being planed,
  (1) two of said rollers being coaxial with one another and being mounted on said frame member adjacent to said ends thereof to be spaced to opposite sides of a zone in which the digging instrumentality operates during forward movement movement of the machine, and
  (2) the third of said rollers being mounted on said front member of the housing, intermediate is connections with said side walls, to be spaced in front of the digging instrumentality.

3. The pavement planing machine of claim 1, further characterized in that said third roller is heightwise adjsutably mounted on said front member for establishing the distance between said rotational axis and the surface of pavement traversed by the machine, for thus controlling the depth of a cut made by the digging instrumentality.

4. The pavement planing machine of claim 1, further characterized in that said top wall of the housing comprises a cover that is hingedly connected to said front member to be swingable upwardly and forwardly for access to said digging instrumentality.

5. The pavement planing machine of claim 1 wherein said digging instrumentality comprises a hollow drum having a substantially cylindrical wall from which a plurality of picks project substantially radially, having opposite ends, and having a pair of radially inwardly extending flanges, each secured to said cylindrical wall inwardly adjacent to one of those ends, further characterized by:

(1) a bearing secured to one of said flanges in concentric relation to said cylindrical wall;
(2) a planetary transmission mechanism
  (a) having coaxial relatively stationary and relatively rotatable elements and
  (b) having its relatively rotatatable element secured to the other of said flanges in concentric relation to said cylindrical wall;
(3) said mounting means comprising
  (a) a stationary stub shaft detachably fixed to one of said walls and projecting inwardly therefrom to be received in said bearing, and
  (b) means detachably securing the relatively stationary element of said planetary transmission mechanism to the other of said side walls in coaxial relation to said stub shaft; and
(4) a pressure fluid energize rotary motor
  (a) connectable with said pressure fluid source for energization therefrom,
  (b) detachably secured to said other side wall, and (c) having an output shaft coaxially received in said relatively rotatable element and drivingly connected with the same.

6. A pavement planing machine for removable attachment to a self-propelling vehicle such as a front end loader that has a pair of life arms, each outwardly adjacent to one of a pair of opposite sides of the vehicle, which are swingable up and down in unison about a laterally extending arm axis near a rear end of the vehicle and project forward from that axis to have front ends in front of a front end of the vehicle, said vehicle further having attachment means on the front ends of said arms providing for removable attachment of a bucket to said arms and for swinging of the bucket relative to said arms about a bucket axis that is near their front ends and is parallel to said arm axis, and pressure fluid energizable arm actuating means connected with a pressure fluid source on the vehicle for controlledly raising and lowering said arms, said pavement planing machine comprising:

A. a housing that is substantially open at its bottom and has a pair of opposit upright side walls that are rigidly connected with one another and are spaced apart by a distance substantially smaller than the distance between said arms;

B. mounting means on each of said side walls for removably supporting a digging instrumentality that is rotatable in the housing, said mounting means defining a rotation axis substantially normal to said side walls about which said instrumentatlity is rotatable and which is fixed in relation to said housing to partake of all motion thereof;

C. a upright fram member removably securable to said attachment means to replace said bucket and to be swingable about said bucket axis, said frame member having laterally opposite ends and having a width between those ends to extend laterally across the entire distance between said arms;

D. a carrier confined between said frame member and said housing;

E. cooperating guide means on said frame member and on said carrier confining the latter to lateral motion relative to the frame member between an off-center position near one of said ends of the frame member and a central position intermediate said ends of the frame member;

F. cooperating pivot means on said carrier and on said housing confining the housing to tilting adjustment relative to the carrier about a fore-and-aft extending tilting axis which is adjacent to the side wall of the housing that is remote from said one end of the frame member;

G. cooperating releasable clamping means on said carrier and on said housing for releasably confining the housing against tilting relative to the carrier and thus maintaining the rotation axis in a selected position of inclination to the horizontal; and H. pressure fluid actuated expansible and retractable jack means (1) connectable with said pressure fluid source, (2) having at one end thereof a connection with said frame member that is near the other of its said ends; and (3) having at an opposite end thereof a connection with said housing which is adjacent to said side wall that is remote from said one end of the frame member and is vertically spaced from said tilting axis, so that said jack means can effect lateral shifting of the carrier relative to the frame member and can control tilting of the housing relative to the carrier.

7. The pavement planing machine of claim 6, further characterized in that (1) one of said connections of said jack means is at a level substantially below that of said rotation axis, and (2) the other of said connections of said jack means is at a level substantially above that of said rotation axis.

* * * * *